US010068552B2

(12) United States Patent
Meng et al.

(10) Patent No.: US 10,068,552 B2
(45) Date of Patent: Sep. 4, 2018

(54) DISPLAY DRIVING METHOD, UPPER MACHINE, LOWER MACHINE AND DISPLAY DRIVING SYSTEM

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Zhaohui Meng, Beijing (CN); Guangjun Zhang, Beijing (CN); Zhifu Li, Beijing (CN); Xue Dong, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 15/164,185

(22) Filed: May 25, 2016

(65) Prior Publication Data

US 2016/0351100 A1 Dec. 1, 2016

(30) Foreign Application Priority Data

May 29, 2015 (CN) ..... 2015 1 0290852

(51) Int. Cl.

*G09G 3/36* (2006.01)
*G09G 5/06* (2006.01)
*G09G 5/36* (2006.01)

(52) U.S. Cl.

CPC ..... *G09G 5/363* (2013.01); *G09G 5/06* (2013.01); *G09G 2340/0428* (2013.01);
(Continued)

(58) Field of Classification Search

CPC .. G09G 5/363; G09G 5/06; G09G 2340/0428; G09G 2360/08; G09G 2370/00; G09G 2370/08

See application file for complete search history.

(56) References Cited

U.S. PATENT DOCUMENTS

2006/0109276 A1* 5/2006 Ooga ..... G06T 1/60 345/530
2008/0106510 A1* 5/2008 Yin ..... G09G 3/20 345/98

FOREIGN PATENT DOCUMENTS

CN 1222720 A 7/1999
CN 1450520 A 10/2003
(Continued)

OTHER PUBLICATIONS

Second Chinese Office Action dated Mar. 28, 2017; Appln. No. 201510290852.3.
(Continued)

*Primary Examiner* — Stephen G Sherman
(74) *Attorney, Agent, or Firm* — Ladas & Parry LLP

(57) ABSTRACT

Disclosed is a display driving method, an upper machine, a lower machine and a display driving system. The method includes: acquiring, by a lower machine, an address for any of subpixels transmitted from an upper machine; looking up, by the lower machine, a gray scale data corresponding to the pointer address in a display Look-UP Table (LUT), wherein the LUT stores mapping relationships between respective pointer addresses and their corresponding gray scale data; performing, by the lower machine, a digital-analog conversion on the gray scale data to acquire a converted analog voltage; and outputting the analog voltage to the subpixel so as to drive the subpixel for displaying. The method can increase the transmission rate between the GPU and the
(Continued)

display to a certain degree and reduce the power consumption thereof.

16 Claims, 4 Drawing Sheets

(52) U.S. Cl.
CPC ..... *G09G 2360/08* (2013.01); *G09G 2370/00* (2013.01); *G09G 2370/08* (2013.01)

(56) References Cited

FOREIGN PATENT DOCUMENTS

| | | | |
|---|---|---|---|
| CN | 1643792 | A | 7/2005 |
| CN | 1776802 | A | 5/2006 |
| CN | 101004901 | A | 7/2007 |
| CN | 202067262 | U | 12/2011 |
| JP | 2001-352456 | A | 2/2001 |

OTHER PUBLICATIONS

First Chinese Office Action dated Dec. 27, 2016; Appln. No. 201510290852.3.

* cited by examiner

DISPLAY DRIVING METHOD, UPPER MACHINE, LOWER MACHINE AND DISPLAY DRIVING SYSTEM

TECHNICAL FIELD

The present disclosure relates to a field of display technique, and particularly to a display driving method, an upper machine, a lower machine and a display driving system.

BACKGROUND

A Graphics Processing Unit (GPU) is a microprocessor dedicated to image data operations on a computer system, which is used to convert the display information required by the computer system for driving, to provide row scan signals to a display and control the display for displaying normally.

Existing interfaces mostly used between the GPU and an IC chip of the display are TTL (Transistor-Transistor Logic) interface, LVDS (Low Voltage Differential signaling) interface, etc. When gray scale data is transmitted, gray scale values of subpixels in each of pixel units on the display are transmitted to the IC chip on one bus respectively. By taking a picture of 1280*800 pixels as an example, each of rows has 1280 pixel units each consisting of three subpixels, R, G and B, and therefore the GPU has to transmit 1280*3 values to the IC chip sequentially in order to transmit the gray scale values of each subpixel respectively as an image of the row is displayed.

FIG. 1 shows an existing transmission format for 8-bit gray scale data wherein 4 pairs of physical lines are required in total to represent 4 rows of gray scale data. For example, when the gray scale value of the subpixel R to be transmitted is 255 (which is converted to 11111111 as a binary value), R0-R7 are all at a high level at this time, while G0-G7 and B0-B7 are all at a low level, so that the IC chip can determine the gray scale value of the current R subpixel as 255 when it receives the data in such format, and in turn outputs the same to a corresponding pixel point on the display.

It can be seen that the 8-bit gray scale data can only have 256 levels, namely 256 gray scale values at most, that is, 0-255, but many gray scale data are transmitted repeatedly when the gray scale data is transmitted. By taking the transmission format of the 8-bit gray scale data illustrated in FIG. 1 as an example, a large number of repeated transmissions would constraint a transmission rate between the GPU and the display, resulting in a waste of resources and in turn increase power consumptions of the GPU and the display.

SUMMARY

Embodiments of the present disclosure provide a display driving method, an upper machine, a lower machine and a display driving system, which can increase the transmission rate between the GPU and the IC chip to a certain degree and reduce the power consumption of the display.

In view of this, the embodiments of the present disclosure propose solutions as follows.

In an first aspect, the embodiments of the present disclosure provide a display driving method, comprising:

acquiring, by a lower machine, an address for any of subpixels transmitted from an upper machine;

looking up, by the lower machine, a gray scale data corresponding to the pointer address in a LUT (Look-UP Table), wherein the LUT stores mapping relationships between respective pointer addresses and their corresponding gray scale data;

performing, by the lower machine, a digital-analog conversion on the gray scale data to acquire a converted analog voltage; and outputting the analog voltage to the subpixel so as to drive the subpixel for displaying.

Combined with the first aspect, in a first possible implementation of the first aspect, the pointer address comprises a row pointer address and a column pointer address, the row pointer address is used for indicating the gray scale data in a row in the LUT, and the column pointer address is used for indicating the gray scale data in a column in the LUT; wherein, looking up, by the lower machine, the gray scale data corresponding to the pointer address in the LUT comprises:

determining, by the lower machine, an intersection data between the gray scale data indicated by the row pointer address and the gray scale data indicated by the column pointer address as the gray scale data for the subpixel.

Combined with the first aspect, in a second possible implementation of the first aspect, before the lower machine receives the pointer address for the subpixel transmitted from the upper machine, the method further comprises:

storing, by the lower machine, the gray scale data corresponding to each of the pointer addresses in an established LUT.

Combined with the first or second possible implementation of the first aspect, in a third possible implementation of the first aspect, the LUT comprises 4 row pointer addresses and 64 column pointer addresses; alternatively, the LUT comprises 1 row pointer address and 64 column pointer addresses.

In a second aspect, the embodiments of the present disclosure provide a display driving method, comprising:

acquiring, by a upper machine, a gray scale data for any of subpixels;

allocating, by the upper machine, an address for the gray scale data according to a display Look Up Table (LUT) so as to obtain a pointer address allocated to the gray scale data, wherein the LUT stores mapping relationships between respective pointer addresses and their corresponding gray scale data;

transmitting, by the upper machine, the pointer address to the lower machine in a form of a differential signal, such that the lower machine drives the subpixel for displaying according to the pointer address.

Combined with the second aspect, in a first possible implementation of the second aspect, the pointer address comprises a row pointer address and a column pointer address, the row pointer address is used for indicating the gray scale data in a row in the LUT, and the column pointer address is used for indicating the gray scale data in a column in the LUT; wherein, before the upper machine acquires the gray scale data for any of the subpixel, the method further comprises:

encoding, by the upper machine, all of the gray scale data to obtain the encoded pointer addresses of the respective gray scale data;

dividing, by the upper machine, the pointer addresses into the row pointer addresses and the column pointer address, and tabulating the same, so as to obtain the tabulated LUT.

In a third aspect, the embodiments of the present disclosure provide a lower machine, comprising:

an acquiring unit operable to acquire a pointer address for any of subpixels transmitted from an upper machine;

a decoding unit operable to look up a gray scale data corresponding to the pointer address in a display Look-Up Table (LUT), wherein the LUT stores mapping relationships between respective pointer addresses and their corresponding gray scale data;

a converting unit operable to perform a digital-analog conversion on the gray scale data to obtain a converted analog voltage for the subpixel; and an output unit operable to output the analog voltage to the subpixel so as to drive the subpixel for displaying.

Combined with the third aspect, in a first possible implementation of the third aspect, the decoding unit is further used to determine an intersection data between a gray scale data indicated by a row pointer address and a gray scale data indicated by a column pointer address as the gray scale data for the subpixel;

wherein the pointer address comprises the row pointer address and the column pointer address, the row pointer address is used for indicating the gray scale data in a row in the LUT, and the column pointer address is used for indicating the gray scale data in a column in the LUT.

Combined with the third aspect, in a second possible implementation of the third aspect, the lower machine further comprises:

a storing unit operable to store the gray scale data corresponding to each of the pointer addresses in the established LUT.

In a fourth aspect, the embodiments of the present disclosure provide an upper machine, comprising:

an acquiring unit operable to acquire a gray scale data for any of subpixels;

an address allocation unit operable to allocate an address for the gray scale data according to a display Look Up Table (LUT) so as to obtain a pointer address allocated to the gray scale data, wherein the LUT stores mapping relationships between respective pointer addresses and their corresponding gray scale data;

a transmitting unit operable to transmit the pointer address to the lower machine in a form of a differential signal, such that the lower machine drives the subpixel for displaying according to the pointer address.

Combined with the fourth aspect, in a first possible implementation of the fourth aspect, the upper machine further comprises:

an encoding unit operable to encode all of the gray scale data to obtain the encoded pointer addresses of the respective gray scale data; and a tabulating unit operable to divide the pointer addresses into the row pointer addresses and the column pointer addresses, and tabulate the same, so as to obtain the tabulated LUT;

wherein the pointer address comprises a row pointer address and a column pointer address, the row pointer address is used for indicating the gray scale data in a row in the LUT, and the column pointer address is used for indicating the gray scale data in a column in the LUT.

In a fifth aspect, the embodiments of the present disclosure provide a display driving system comprising the lower machine described above in any of implementations in the third aspect and the upper machine described above in any of implementations in the fourth aspect which is connected with the lower machine.

The embodiments of the present disclosure provide the display driving method, the upper machine, the lower machine and the display driving system. The LUT in the lower machine stores the mapping relationships between respective pointer addresses and their corresponding gray scale data, therefore by acquiring the pointer address for any of subpixel transmitted from the upper machine, the gray scale data corresponding to the pointer address can be looked up in the LUT and decoded, and in turn the gray scale data is digital-analog converted into the analog voltage and output to the subpixel so as to drive the subpixel for displaying. It can be seen that the gray scale data can be determined by transmitting only the pointer address with less bits and decoding the same by the LUT without transmitting the gray scale data for each of the subpixels repeatedly during an interaction between the upper machine and the lower machine. As such, an amount of data transmission between the upper machine and the lower machine can be reduced, an amount of data processing in the lower machine can also be reduced, and in turn a clock frequency during the transmission can be decreased, which can increase the transmission rate between the upper machine and the lower machine, and reduce the power consumptions of thereof.

BRIEF DESCRIPTION OF THE DRAWINGS

In order to explain solutions in embodiments of the present disclosure or the known solutions more clearly, drawings required as describing the embodiments of the present disclosure or the known solution will be introduced briefly below. Obviously, the drawings described below are only some embodiments of the present disclosure, but those ordinary skilled in the art can obtain other drawings according to these drawings without paying any inventive labors.

DETAILED DESCRIPTION

Thereafter, in order to assist understanding of the present disclosure thoroughly, some specific details, such as a specific system configuration, an interface, a technique, are illustrated only for description other than limitation. However, those skilled in the art should understand that the present disclosure can also be implemented with other embodiments without such specific details. In other cases, descriptions for some well-known apparatus, circuits and methods would be omitted in order to avoid disturbing the subject matter of the present disclosure with unnecessary details.

Embodiment 1

Figure 2:
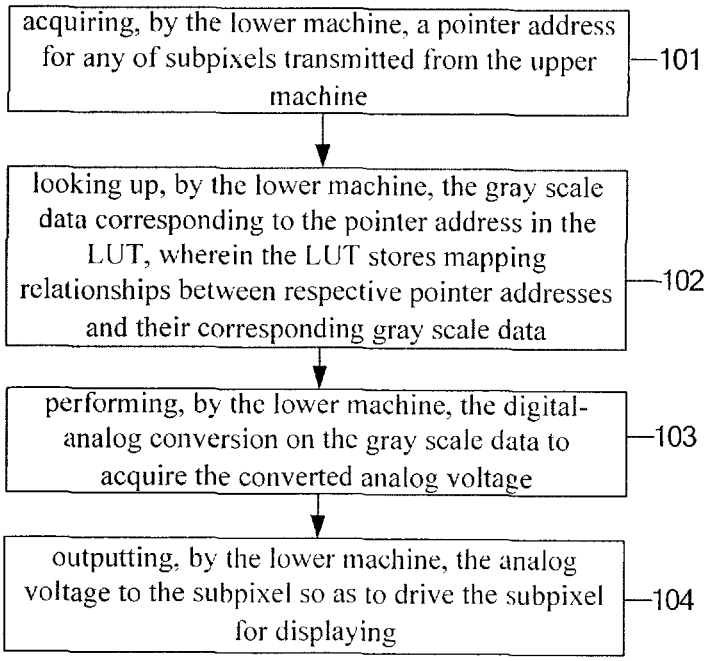
FIG. 2 is an exemplary flowchart illustrating a first display driving method according to the embodiments of the present disclosure.

The embodiments of the present disclosure provide a display driving method, as illustrated in FIG. 2, comprising:

101, acquiring, by a lower machine, a point address to be transmitted to any of subpixels from an upper machine;

102, looking up a gray scale data, by a lower machine, corresponding to the pointer address in a LUT (Look-UP Table), wherein the LUT stores mapping relationships between respective pointer addresses and their corresponding gray scale data;

103, performing a digital-analog conversion, by a lower machine, on the gray scale data to acquire a converted analog voltage; and

104, outputting the analog voltage from the lower machine to the subpixel so as to drive the subpixel for displaying.

The display driving method according to the present disclosure can be applied to a process for an interaction of the gray scale data between the upper machine and the lower machine when pixels of the display are driven for displaying. Particularly, the gray scale data (namely gray scale values, that is, levels of dark or light of shades on a black and white image represented by radiation intensity of objects' electromagnetic wave, for example, a display with 8 bits can represent the eighth power of 2, which is equal to 256 brightness levels, that is, level 0-255, 256 gray scale values in total) for the respective subpixels in the display are required to be determined during the display, in order to improve a transmission efficiency of the gray scale data between the upper machine and the lower machine, the display driving method according to the embodiments of the present disclosure further comprises:

in step 101, acquiring, by the lower machine, a pointer address to be transmitted to any of the subpixels from an upper machine.

In an example, the upper machine can refer to a computer capable of issuing operation instructions, for example, a Graphic Processing Unit (GPU) or a host computer, etc.; and the lower machine can refer to a computer capable of controlling a device directly and acquiring the device's status, for example, an IC chip or a SCM, etc.

In an example, in order to determine the gray scale data for a subpixel, the lower machine can receive the address of the subpixel transmitted from the upper machine, and then acquire the pointer address to be transmitted to the subpixel from the upper machine, so that the lower machine determines the gray scale data for the subpixel according to the pointer address, transmits an analog voltage corresponding to the gray scale data to the address of the subpixel, and finally drives the subpixel for displaying.

A method for determining the pointer address of any of the subpixels by the upper machine would be explained in following embodiments, and details are not repeated herein.

In step 102, after the lower machine acquires the pointer address for any of subpixels, the lower machine can look up the gray scale data corresponding to the pointer address in a display Look-Up Table (LUT) including a mapping relationship between the respective pointer addresses and their corresponding gray scale data since the LUT has been stored in the lower machine.

Before step 101, the lower machine can establish the LUT itself in advance, or receive the LUT transmitted from the upper machine, so as to establish the mapping relationship between the respective pointer addresses and the corresponding gray scale data. For example, as illustrated in Table 1, in the LUT, the pointer address can comprise a row pointer address and a column pointer address, wherein the row pointer address is used for indicating the gray scale data in a row in the LUT, and the column pointer address is used for indicating the gray scale data in a column in the LUT. In this way, after acquiring the row pointer address n ($0<n\leq N$) and the column pointer address m ($0<m\leq M$) for any of the subpixels, the lower machine can look up an intersection data between the gray scale data indicated by the row pointer address n and the gray scale data indicated by the column pointer address m according to the Table 1, namely the gray scale data for the subpixel.

TABLE 1

| | column pointer address 1 | column pointer address 2 | . . . | column pointer address M |
|---|---|---|---|---|
| row pointer address 1 | gray scale data 1 | gray scale data 2 | . . . | gray scale data M |
| . . . | . . . | . . . | . . . | . . . |
| row pointer address N | gray scale data (N − 1) * M + 1 | gray scale data (N − 1) * M + 2 | . . . | gray scale data N * M |

Figure 3:
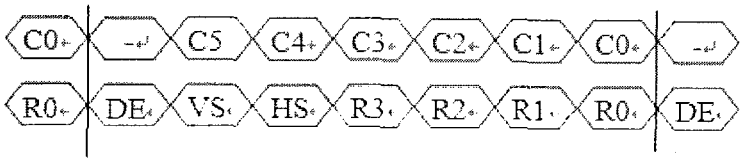
FIG. 3 is an exemplary view illustrating a transmission format for a 8-bit pointer address according to the embodiments of the present disclosure.

As an example, because the display with 8 bits includes 0-255, total 256 gray scale values, the LUT can be designed in a form of 4*64, as illustrated in Table 2, that is, the LUT comprises 4 rows and 64 columns. Thus, a transmission format for transmitting the pointer address by the upper machine is as illustrated in FIG. 3, wherein C0-C5 indicate the sixth power of 2, namely total 64 column pointer addresses, and R0-R3 indicate the four row pointer addresses respectively. For example, by taking a case wherein 1 represents the high level and 0 represents the low level as an example, when the upper machine transmits the pointer address in the transmission format illustrated in FIG. 3, if R0 is at the high level, R1-R3 are at the low level and C0-C5 are all at the high level, the pointer address is (R0, 111111), namely (R0, 0x3F), then the gray scale data corresponding to (R0, 0x3F) can be obtained as 63 according to the LUT as illustrated as Table 2.

TABLE 2

| | 0x00 | 0x01 | 0x02 | . . . | 0x3D | 0x3E | 0x3F |
|---|---|---|---|---|---|---|---|
| R0 | 0 | 1 | 2 | . . . | 61 | 62 | 63 |
| R1 | 64 | 65 | 66 | . . . | 125 | 126 | 127 |
| R2 | 128 | 129 | 130 | . . . | 189 | 190 | 191 |
| R3 | 192 | 193 | 194 | . . . | 253 | 254 | 255 |

Figure 1:
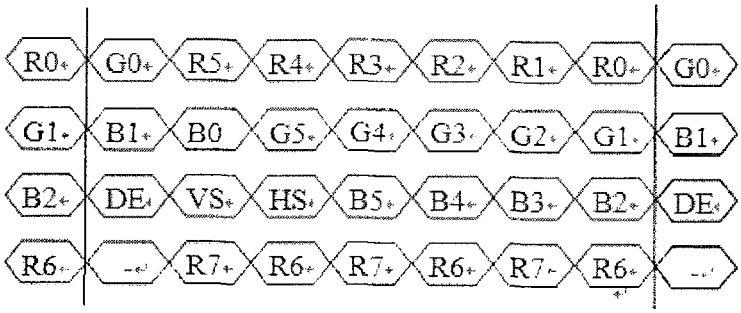
FIG. 1 is an exemplary view illustrating a transmission format for a 8-bit gray scale data in a known solution.

It can be seen that an amount of the data transmission between the upper machine and the lower machine in the display driving method according to the embodiments of the present disclosure is much less than that in the existing method using the transmission format with 8-bit illustrated in FIG. 1, thus a transmission rate between the upper machine and the lower machine can be increased, and power consumptions of the upper machine and the lower machine can be reduced.

Figure 4:
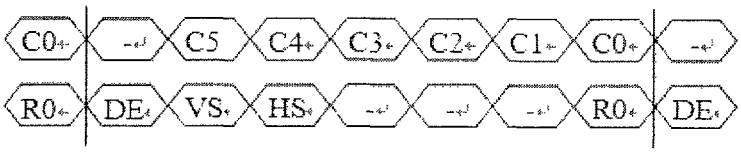
FIG. 4 is an exemplary view illustrating a transmission format for a 6-bit pointer address according to the embodiments of the present disclosure.

Additionally, the design for the LUT described above can also be compatible with the display of 6-bit, that is, it can cover a data transmission scheme having total 64 gray scale values, 0-63, as illustrated in Table 3, and the row pointer addresses for R1-R3 in Table 2 can be omitted, therefore the above LUT is designed in a form of 1*64. In this case, a transmission format for transmitting the pointer address by the upper machine is as illustrated in FIG. 4, wherein the C0-C5 still indicate the sixth power of 2, namely total 64, column pointer addresses, and the R0 is at the high level at this time (provided that 1 represents the high level) to indicate the only one row pointer address.

TABLE 3

| | 0x00 | 0x01 | 0x02 | . . . | 0x3D | 0x3E | 0x3F |
|---|---|---|---|---|---|---|---|
| R0 | 0 | 1 | 2 | . . . | 61 | 62 | 63 |

From the above, it can be seen that, with the above data transmission scheme, the traditional transmission format for the gray scale data illustrated in FIG. 1 can be simplified, and a probability of external interference on data is decreased. Furthermore, only two pairs of physical wires, namely four physical wires, are needed to form a periphery circuit because the transmission format illustrated in FIGS. 3 and 4 only have two rows of data, which can simplify a manufacture process and save a cost as compared with the existing scheme which requires 4 pairs of physical wires (total 8 physical wires) to represent 4 rows of gray scale data.

Next, in step 103, the lower machine performs a digital-analog conversion on the gray scale data to acquire a converted analog voltage after the lower machine determines the gray scale data in the step 102.

Next, in step 104, the lower machine outputs the analog voltage to the corresponding subpixel according to the acquired pointer address of the subpixel so as to drive the subpixel for displaying.

The embodiments of the present disclosure provide a display driving method. The LUT in the lower machine stores the mapping relationships between respective pointer addresses and their corresponding gray scale data, therefore by acquiring the pointer address to be transmitted to any of subpixel from the upper machine, the gray scale data corresponding to the pointer address can be looked up in the LUT and decoded, and in turn the gray scale data is digital-analog converted into the analog voltage and output to the subpixel so as to drive the subpixel for displaying. It can be seen that the gray scale data can be determined by transmitting only the pointer address with less bits and decoding the same by the LUT without transmitting the gray scale data for each of the subpixels repeatedly during an interaction between the upper machine and the lower machine. As such, an amount of data transmission between the upper machine and the lower machine can be reduced, an amount of data processing in the lower machine can also be reduced, and in turn a clock frequency during the transmission can be decreased, which can increase the transmission rate between the upper machine and the lower machine, and reduce the power consumptions thereof.

Embodiment 2

Figure 5:
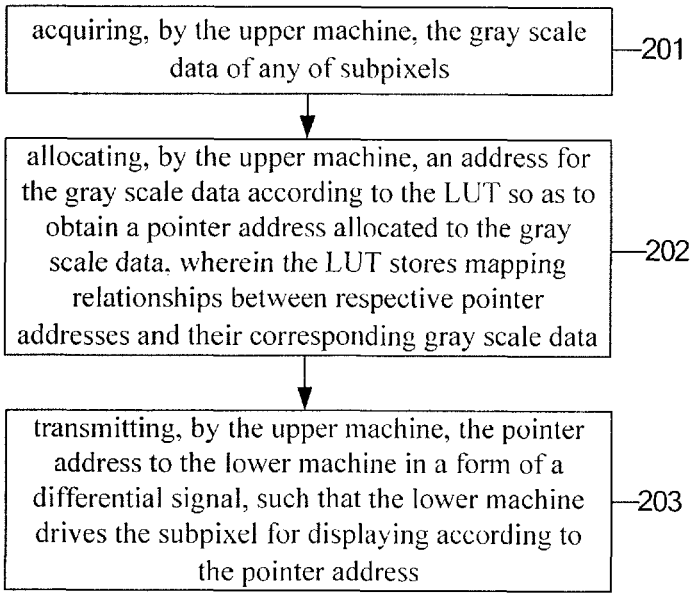
FIG. 5 is an exemplary flowchart illustrating a second display driving method according to the embodiments of the present disclosure.

The embodiments of the present disclosure provide a display driving method, as illustrated in FIG. 5, the method comprises:

201, acquiring, by the upper machine, the gray scale data for any of subpixels;

202, allocating, by the upper machine, an address for the gray scale data according to a LUT so as to obtain a pointer address allocated to the gray scale data, wherein the LUT stores mapping relationships between respective pointer addresses and their corresponding gray scale data; and

203, transmitting, by the upper machine, the pointer address to the lower machine in a form of a differential signal, such that the lower machine drives the subpixel for displaying according to the pointer address.

Similarly to the Embodiment 1 described above, before the steps 201-203 are performed, a LUT such as any one of the Table 1-Table 3 is pre-stored in the upper machine, therefore the upper machine allocates the address to the acquired gray scale data for anyone of the subpixels according to the LUT, when a display is driven, transmits the obtained pointer address to the lower machine, so that the lower machine drives the subpixel for displaying according to the pointer address.

In an example, when the LUT is stored, the upper machine is required to encode all of the gray scale data so as to obtain the encoded pointer address for each of the gray scale data. For example, the display of 8-bit has total 256 gray scale data, that is, 0-255, then the gray scale data 1 can be encoded as R00x00, the gray scale data 2 can be encoded as R00x01, . . . , and so on, thus the pointer addresses corresponding to the gray scale data 0-255 can be obtained respectively.

Next, the upper machine classifies the pointer addresses into the row pointer addresses and the column pointer address, and tabulates the same so as to obtain the LUT as illustrated in Table 2, so that the mapping relationship between the respective pointer addresses and their corresponding gray scale data is established in the upper machine. Of course, the upper machine can further transmit the tabulated LUT to the lower machine and the lower machine can decode according to the LUT.

In the step 201, the upper machine acquires the gray scale data to be displayed for any one of the subpixel in order to drive the corresponding subpixel on the display for displaying, after the upper machine has established the mapping relationships between respective pointer addresses and their corresponding gray scale data.

Next, in step 202, the upper machine allocates the address to the gray scale data obtained in step 201 according to the established LUT and acquires the pointer address allocated to the gray scale data. The pointer address comprises the row pointer address and the column pointer address, wherein the row pointer address is used for indicating the gray scale data in a row in the LUT, and the column pointer address is used for indicating the gray scale data in a column in the LUT.

As an example, if the gray scale data to be displayed of the subpixel is 255, the upper machine allocates an address to the gray scale data 255 according to the LUT illustrated as the Table 3 and obtains the pointer address for the gray scale data 255 as (R3, 0x3F), that is, the row pointer address is R3 and the column pointer address is 0x3F.

Then, as described in the step 203, the upper machine transmits the pointer address obtained in the step 202 to the lower machine such that the lower machine decodes the gray scale data according to the pointer address and determines the gray scale data for the subpixel.

In an example, also taking the exemplary case in the step 202 as the example, the pointer address for the gray scale data 255 is (R3, 0x3F), namely (R3, 111111), and the pointer address (R3, 111111) can be transmitted to the lower machine via an interface such as a TTL or a LVDS, etc., according to the transmission format as illustrated in FIG. 3. In this case, the row pointer address is R3 and the column pointer address is 0x3F, that is to say, R3 is at the high level and C0-C5 are all at the high level. It should be noted that 1 presents the high level and 0 represents the low level throughout the embodiments of the present disclosure, but it is only exemplary and the present disclosure is not limited thereto.

Therefore, the upper machine obtains the pointer address corresponding to the gray scale data after it encodes the gray scale data to be output, and transmits the pointer address to the lower machine, such that the lower machine decodes the gray scale data according to the pointer address and the LUT so as to determine the gray scale data for the subpixel, and finally outputs the analog voltage corresponding to the gray scale data to the subpixel and drives the subpixel for displaying.

The embodiments of the present disclosure provide the display driving method. The LUT in the lower machine stores the mapping relationships between respective pointer address and its corresponding gray scale data, and therefore by acquiring the pointer address transmitted to any of subpixel from the upper machine, the gray scale data corresponding to the pointer address can be looked up in the LUT and decoded, and in turn the gray scale data is digital-analog converted into the analog voltage and output to the subpixel so as to drive the subpixel for displaying. It can be seen that the gray scale data can be determined by transmitting only the pointer address with less bits and decoding the gray scale data by the LUT without transmitting the gray scale data for each of the subpixels repeatedly during an interaction between the upper machine and the lower machine. As such, an amount of data transmission between the upper machine and the lower machine can be reduced, an amount of data processing in the lower machine can also be reduced, and in turn a clock frequency during the transmission can be decreased, which can increase the transmission rate between the upper machine and the lower machine, and reduce the power consumptions of thereof.

Embodiment 3

Figure 6:
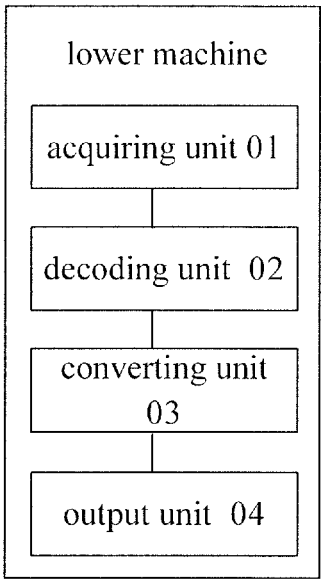
FIG. 6 is an exemplary view illustrating a first configuration of a lower machine according to the embodiments of the present disclosure.

FIG. 6 is an exemplary view illustrating a first configuration of a lower machine according to the embodiments of the present disclosure. The lower machine according to the embodiment of the present disclosure can be implemented to accomplish any methods according to the embodiments of the present disclosure illustrated in FIGS. 1-5. FIG. 6 only illustrates parts related to the present embodiment for a purpose of convenience, and for other details, please refer to the embodiments illustrated in FIGS. 1-5.

Particularly, the embodiments of the present disclosure provide a lower machine, as illustrated in FIG. 6, the lower machine comprises:

an acquiring unit 01 operable to acquire the pointer address for any of subpixels transmitted from the upper machine;

a decoding unit 02 operable to look up the gray scale data corresponding to the pointer address in the LUT, wherein the LUT stores mapping relationships between respective pointer addresses and their corresponding gray scale data;

a converting unit 03 operable to perform the digital-analog conversion on the gray scale data to obtain a converted analog voltage of the subpixel; and an output unit 04 operable to output the analog voltage to the subpixel so as to drive the subpixel for displaying.

In an example, the decoding unit 02 is further used to determine an intersection data between a gray scale data indicated by a row pointer address and a gray scale data indicated by a column pointer address as the gray scale data for the subpixel;

wherein the pointer address comprises the row pointer address and the column pointer address, the row pointer address is used for indicating the gray scale data in a row in the LUT, and the column pointer address is used for indicating the gray scale data in a column in the LUT.

Figure 7:
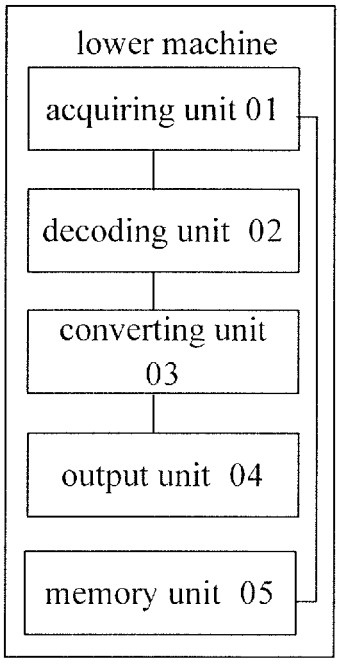
FIG. 7 is an exemplary view illustrating a second configuration of a lower machine according to the embodiments of the present disclosure.

In an example, as illustrated in FIG. 7, the lower machine further comprises:

a storing unit 05 operable to store the gray scale data corresponding to each of the pointer addresses in the established LUT.

Figure 8:
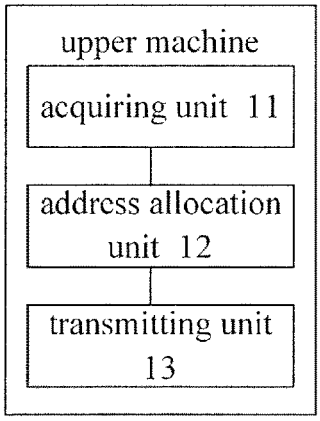
FIG. 8 is an exemplary view illustrating a first configuration of an upper machine according to the embodiments of the present disclosure.

Furthermore, FIG. 8 is an exemplary view illustrating a configuration of an upper machine according to the embodiments of the present disclosure. The upper machine according to the embodiment of the present disclosure can be implemented to accomplish any methods according to the embodiments of the present disclosure illustrated in FIGS. 1-5. FIG. 8 only illustrates parts related to the present embodiment for a purpose of convenience, and for other details, please refer to the embodiments illustrated in FIGS. 1-5.

In an example, the embodiments of the present disclosure provide an upper machine, as illustrated in FIG. 8, the upper machine comprises:

an acquiring unit 11 operable to acquire the gray scale data for any of subpixels;

an address allocation unit 12 operable to allocate the address for the gray scale data according to the LUT so as to obtain the pointer address allocated to the gray scale data, wherein the LUT stores mapping relationships between respective pointer addresses and their corresponding gray scale data;

a transmitting unit 13 operable to transmit the pointer address to the lower machine in a form of a differential signal, such that the lower machine drives the subpixel for displaying according to the pointer address.

Figure 9:
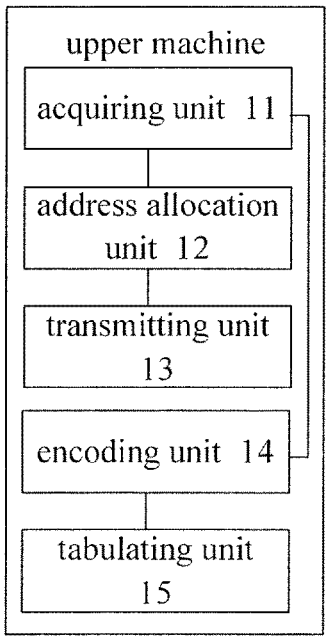
FIG. 9 is an exemplary view illustrating a second configuration of an upper machine according to the embodiments of the present disclosure.

Further, as illustrated in FIG. 9, the upper machine further comprises:

an encoding unit 14 operable to encode all of the gray scale data to obtain the encoded pointer addresses of the respective gray scale data; and a tabulating unit 15 operable to divide the pointer addresses into the row pointer addresses and the column pointer address, and tabulate the same, so as to obtain the tabulated LUT;

wherein the pointer address comprises the row pointer address and the column pointer address, the row pointer address is used for indicating the gray scale data in a row in the LUT, and the column pointer address is used for indicating the gray scale data in a column in the LUT.

The embodiments of the present disclosure provide an upper machine and a lower machine. The LUT in the lower machine stores the mapping relationships between each pointer address and its corresponding gray scale data, therefore by acquiring the pointer address for any of subpixel transmitted from the upper machine, the gray scale data corresponding to the pointer address can be looked up in the LUT and decoded, and in turn the gray scale data is digital-analog converted into the analog voltage and output to the subpixel so as to drive the subpixel for displaying. It can be seen that the gray scale data can be determined by transmitting only the pointer address with less bits and decoding the same by the LUT without transmitting the gray scale data for each of the subpixels repeatedly during an interaction between the upper machine and the lower machine. As such, an amount of data transmission between the upper machine and the lower machine can be reduced, an amount of data processing in the lower machine can also be reduced, and in turn a clock frequency during the transmission can be decreased, which can increase the transmission rate between the upper machine and the lower machine, and reduce the power consumptions thereof.

Embodiment 4

Figure 10:
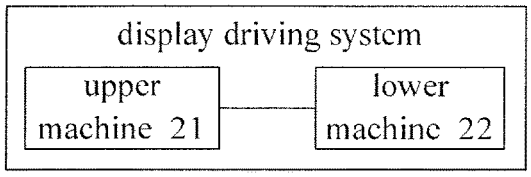
FIG. 10 is an exemplary view illustrating a configuration of a display driving system according to the embodiments of the present disclosure.

FIG. 10 is an exemplary view illustrating a configuration of a display driving system according to the embodiments of the present disclosure. The display driving system according to the embodiment of the present disclosure can be implemented to accomplish any methods according to the embodiments of the present disclosure illustrated in FIGS. 1-5. FIG. 10 only illustrates parts related to the present embodiment for a purpose of convenience, and for other details, please refer to the embodiments illustrated in FIGS. 1-5.

The display driving system comprises an upper machine 21 and a lower machine 22, wherein the upper machine 21 can be a computer capable of issuing operation instructions directly, for example, a Graphic Processing Unit (GPU) or a host computer, etc. The lower machine 22 can be a computer processor for controlling a device directly and acquiring the device's status, for example, an IC chip or a SCM, etc.

In an example, the upper machine 21 sends an instruction or a signal to the lower machine 22 at first, then the lower machine 22 controls the corresponding device directly by parsing the instruction or signal as corresponding timing signal. Further, the lower machine 22 can also read status data of the device at a regular or unregular interval, convert the same into a digital signal and feed the same back to the upper machine 21.

For example, the upper machine 21 transmits the generated pointer address to the IC chip after it allocates the address to the gray scale data for a certain subpixel, then the IC chip decodes the gray scale data according to the pointer address, converts the gray scale data obtained by decoding into the analog voltage and outputs the same to the display so as to drive the display for displaying in the subpixel.

The embodiments of the present disclosure provide a display driving system. The LUT in the lower machine stores the mapping relationships between each pointer address and its corresponding gray scale data, therefore by acquiring the pointer address for any of subpixel transmitted from the upper machine, the gray scale data corresponding to the pointer address can be looked up in the LUT and decoded, and in turn the gray scale data is converted into the analog voltage and output to the subpixel so as to drive the subpixel for displaying. It can be seen that the gray scale data can be determined by transmitting only the pointer address with less bits and decoding the same by the LUT without transmitting the gray scale data for each of the subpixels repeatedly during an interaction between the upper machine and the lower machine. As such, an amount of data transmission between the upper machine and the lower machine can be reduced, an amount of data processing in the lower machine can also be reduced, and in turn a clock frequency during the transmission can be decreased, which can increase the transmission rate between the upper machine and the lower machine, and reduce the power consumptions thereof.

The specified features, configuration, materials or characters described in the present disclosure can be combined in any suitable manners, in any one or more embodiments or examples.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims.

What is claimed is:

1. A display driving method, comprising:

receiving, by a lower machine, only data of a pointer address for any of subpixels transmitted from an upper machine;

looking up, by the lower machine, a gray scale data corresponding to the pointer address in a display Look-UP Table (LUT), wherein the LUT stores mapping relationships between respective pointer addresses and their corresponding gray scale data;

performing, by the lower machine, a digital-analog conversion on the gray scale data to acquire a converted analog voltage; and outputting, by the lower machine, the analog voltage to the subpixel so as to drive the subpixel for displaying.

2. The display driving method of claim 1, wherein the pointer address comprises a row pointer address and a column pointer address, wherein the row pointer address is used for indicating the gray scale data in a row in the LUT, and the column pointer address is used for indicating the gray scale data in a column in the LUT; wherein, looking up, by the lower machine, the gray scale data corresponding to the pointer address in the LUT comprises:

determining, by the lower machine, an intersection data between the gray scale data indicated by the row pointer address and the gray scale data indicated by the column pointer address as the gray scale data for the subpixel.

3. The display driving method of claim 2, wherein the LUT comprises 4 rows and 64 columns; alternatively, the LUT comprises 1 row and 64 columns.

4. The display driving method of claim 1, wherein before the lower machine receives the pointer address for the subpixel transmitted from the upper machine, the method further comprises:

storing, by the lower machine, the gray scale data corresponding to each of the pointer addresses in an established LUT.

5. A display driving method, comprising:

acquiring, by a upper machine, a gray scale data for any of subpixels;

allocating, by the upper machine, an address for the gray scale data according to a display Look Up Table (LUT) so as to obtain a pointer address allocated to the gray scale data, wherein the LUT stores mapping relationships between respective pointer addresses and their corresponding gray scale data; and transmitting, by the upper machine, only data of the pointer address to the lower machine in a form of a differential signal, such that the lower machine drives the subpixel for displaying according to the pointer address.

6. The display driving method of claim 5, wherein the pointer address comprises a row pointer address and a column pointer address, the row pointer address is used for indicating the gray scale data in a row in the LUT, and the column pointer address is used for indicating the gray scale data in a column in the LUT; wherein, before the upper machine acquires the gray scale data for any of the subpixel, the method further comprises:

encoding, by the upper machine, all of the gray scale data to obtain the encoded pointer addresses of the respective gray scale data;

dividing, by the upper machine, the pointer addresses into the row pointer addresses and the column pointer address, and tabulating the same, so as to obtain the tabulated LUT.

7. A lower machine comprising:

a processor configured to:

receive only data of a pointer address for any of subpixels transmitted from an upper machine;

look up a gray scale data corresponding to the pointer address in a display Look-Up Table (LUT), wherein the LUT stores mapping relationships between respective pointer addresses and their corresponding gray scale data;

perform a digital-analog conversion on the gray scale data to obtain a converted analog voltage for the subpixel; and output the analog voltage to the subpixel so as to drive the subpixel for displaying.

8. The lower machine of claim 7, wherein processor is further configured to determine an intersection data between a gray scale data indicated by the row pointer address and a gray scale data indicated by the column pointer address as the gray scale data for the subpixel;

wherein the pointer address comprises the row pointer address and the column pointer address, the row pointer address is configured to indicate the gray scale data in a row in the LUT, and the column pointer address is configured to indicate the gray scale data in a column in the LUT.

9. The lower machine of claim 7, wherein the lower machine further comprises:

a memory configured to store the gray scale data corresponding to each of the pointer addresses in an established LUT.

10. A display driving system comprising the lower machine of claim 7.

11. The display driving system of claim 10, wherein the processor in the lower machine is further configured to determine an intersection data between a gray scale data indicated by a row pointer address and a gray scale data indicated by a column pointer address as the gray scale data for the subpixel;

wherein the pointer address comprises the row pointer address and the column pointer address, the row pointer address is configured to indicate the gray scale data in a row in the LUT, and the column pointer address is configured to indicate the gray scale data in a column in the LUT.

12. The display driving system of claim 10, wherein the lower machine further comprises:

a memory configured to store the gray scale data corresponding to each of the pointer addresses in an established LUT.

13. An upper machine comprising:

a processor configured to:

acquire a gray scale data for any of subpixels;

allocate an address for the gray scale data according to a display Look Up Table (LUT) so as to obtain a pointer address allocated to the gray scale data, wherein the LUT stores mapping relationships between respective pointer addresses and their corresponding gray scale data; and transmit only data of the pointer address to the lower machine in a form of a differential signal, such that the lower machine drives the subpixel for displaying according to the pointer address.

14. The upper machine of claim 13, wherein the processor further configured to:

encode all of the gray scale data to obtain the encoded pointer addresses of the respective gray scale data; and divide the pointer addresses into the row pointer addresses and the column pointer address, and tabulate the same, so as to obtain the tabulated LUT;

wherein the pointer address comprises a row pointer address and a column pointer address, the row pointer address is configured to indicate the gray scale data in a row in the LUT, and the column pointer address is configured to indicate the gray scale data in a column in the LUT.

15. A display driving system comprising the upper machine of claim 13.

16. The display driving system of claim 15, wherein the processor in the upper machine is further configured to:

encode all of the gray scale data to obtain the encoded pointer addresses of the respective gray scale data; and divide the pointer addresses into the row pointer addresses and the column pointer address, and tabulate the same, so as to obtain the tabulated LUT;

wherein the pointer address comprises a row pointer address and a column pointer address, the row pointer address is configured to indicate the gray scale data in a row in the LUT, and the column pointer address is configured to indicate the gray scale data in a column in the LUT.

* * * * *